US006145510A

United States Patent [19]

Clark

[11] Patent Number: 6,145,510

[45] Date of Patent: Nov. 14, 2000

[54] CIGAR EXTINGUISHING SYSTEM PROVIDING CONTROLLABLE BURN OF HAND ROLLED-CIGARS

[76] Inventor: Bob D'Andrea Clark, 3481 Spring Run Dr., Decatur, Ga. 30032

[21] Appl. No.: 09/305,519

[22] Filed: Mar. 31, 1999

[51] Int. Cl.[7] ..... A24F 13/24; A24F 13/18; A24F 19/10; A24F 15/08; A24F 15/18

[52] U.S. Cl. ..... 131/256; 131/235.1; 131/242; 131/242.6; 131/231; 131/238; 131/240.1; 131/241; D27/136

[58] Field of Search ..... 131/256, 242, 131/242.6, 235.1, 231, 238, 240.1, 241; 206/246; D27/136

[56] References Cited

U.S. PATENT DOCUMENTS

| | | | |
|---|---|---|---|
| 2,095,870 | 10/1937 | Hirsh | 131/256 |
| 2,574,813 | 11/1951 | Cadrain | 131/242 |
| 2,661,006 | 12/1953 | Forton | 131/235.1 |
| 3,139,209 | 6/1964 | Wise | 220/23.83 |
| 3,405,719 | 10/1968 | Lustbader | 131/235.1 |
| 4,142,537 | 3/1979 | Fenelon | 131/242.6 |

*Primary Examiner*—James Derrington
*Assistant Examiner*—Dionne A. Walls

[57] ABSTRACT

A cigar extinguishing device which includes a circular top component for tightly holding a burning or smoldering cigar in a vertical position. On a side of the top component is a substantially horizontal ventilation slot having a sliding cover for controlling the burn rate of the cigar. This arrangement also allows the cigar to be extinguished without physically pressing the end into a typical ash tray; thus allowing the cigar to burn evenly and prevents it from unraveling. The ash tray has a removable, lower base unit allowing the ash collecting portion to be easily removed and emptied.

1 Claim, 3 Drawing Sheets

3/4 VIEW—SHOWING BASE BEING REMOVED

PLAN VIEW—TOP

3/4 VIEW–SHOWING BASE BEING REMOVED

CIGAR EXTINGUISHING SYSTEM PROVIDING CONTROLLABLE BURN OF HAND ROLLED-CIGARS

BACKGROUND OF THE INVENTION

1. Field of the Invention

The invention relates to cigar extinguishing systems wherein the device keeps a hand-rolled cigar in a vertical position to acquire an even burn between handling. The device also allows smokers to extinguish cigars at a controlled pace.

Because extinguishing cigars typically require the application of physical pressure to the cigar, breakage and/or bending of fine, expensive cigars is often the result. Application of this physical pressure can also result in an unraveling of the cigar and needless waste of portions of the remaining cigar.

Basic to the enjoyment of cigars is the preservation of the integrity of the cigar both during and after the smoking period. Because the invention provides a snug, flexible fit which holds the cigar vertically for an even, controlled burn, the device enables the smoker to properly save the useable remaining portion of the cigar for a later time.

2. Description of the Prior Art

Various prior art cigar extinguishing systems and the method of their construction are known and are found to be exemplary of the U.S. prior art. They are:

| U. S. Pat. No. | Inventor |
|---|---|
| 4,142,537 | Fenelon |
| 3,139,209 | Wise |
| 2,662,006 | Forton |
| 2574,813 | Cadrain |

The patent issued to Fenelon discloses a telescoping ash tray that may be easily collapsed. The bottom is designed to be weighted with sand or a similar material preventing it from tipping over.

The patent issued to Wise discloses a trivet and drip catching spout mechanism. The drip catch portion may also be used as an ash tray.

The patent issued to Forton discloses an ash tray having helical coin therein for holding a cigarette in a vertical position with the lit end above the ash tray bottom allowing the cigarette to burn evenly.

The patent issued to Cadrain relates to a windproof ash tray having separate compartments and a wire mesh grating. A cigarette may be dragged across the grating allowing the burning members to fall into one compartment. The remainder of the cigarette may then be placed in the other compartment preventing it from contacting the burning members.

These patents, or known prior uses, disclose various types of combination extinguishing and even burn systems for smokers, but none of them, either singularly or collectively, disclose the specific details as to bear upon the claims of the present invention.

SUMMARY OF THE INVENTION

An object, advantage, and feature of the present invention is to provide a novel and controlled approach to extinguishing cigars while also allowing the smoker to maintain an even burn of the cigar and to efficiently preserve the remaining portion of the cigar for later use.

Another object of the present invention is to prevent cigars from unraveling.

Another object of the present invention is to protect furniture and add stability of the device on outdoor furnishings.

Furthermore, another object of the present invention is to provide easier collections of ashes after smoking the cigar.

DESCRIPTION OF THE PREFERRED EMBODIMENT OF THE INVENTION

Figure 1:
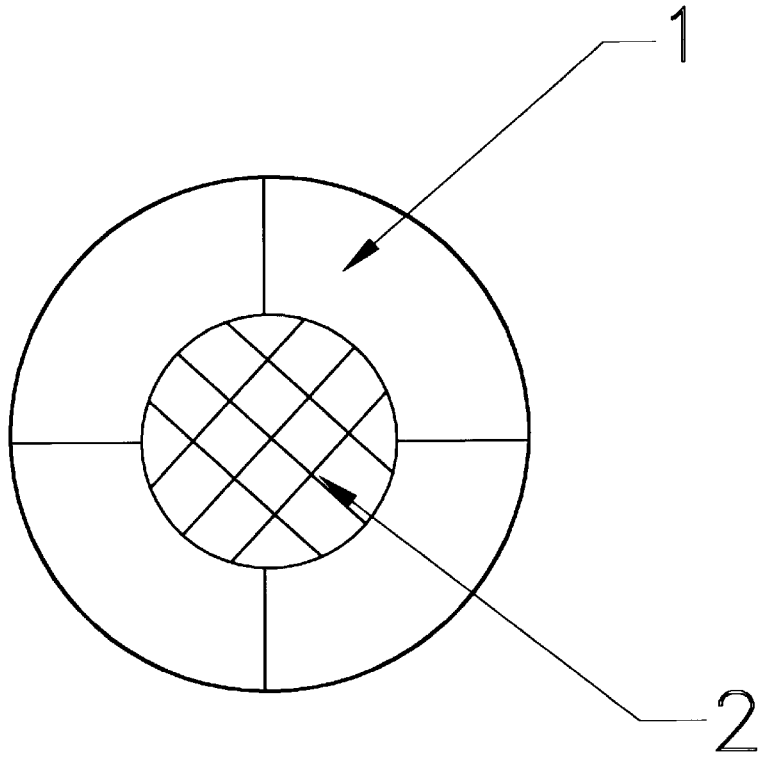
FIG. 1 is a topical view of the device illustrating the circular shape of the flexible rubber membrane and the sunken screen.
Figure 2:
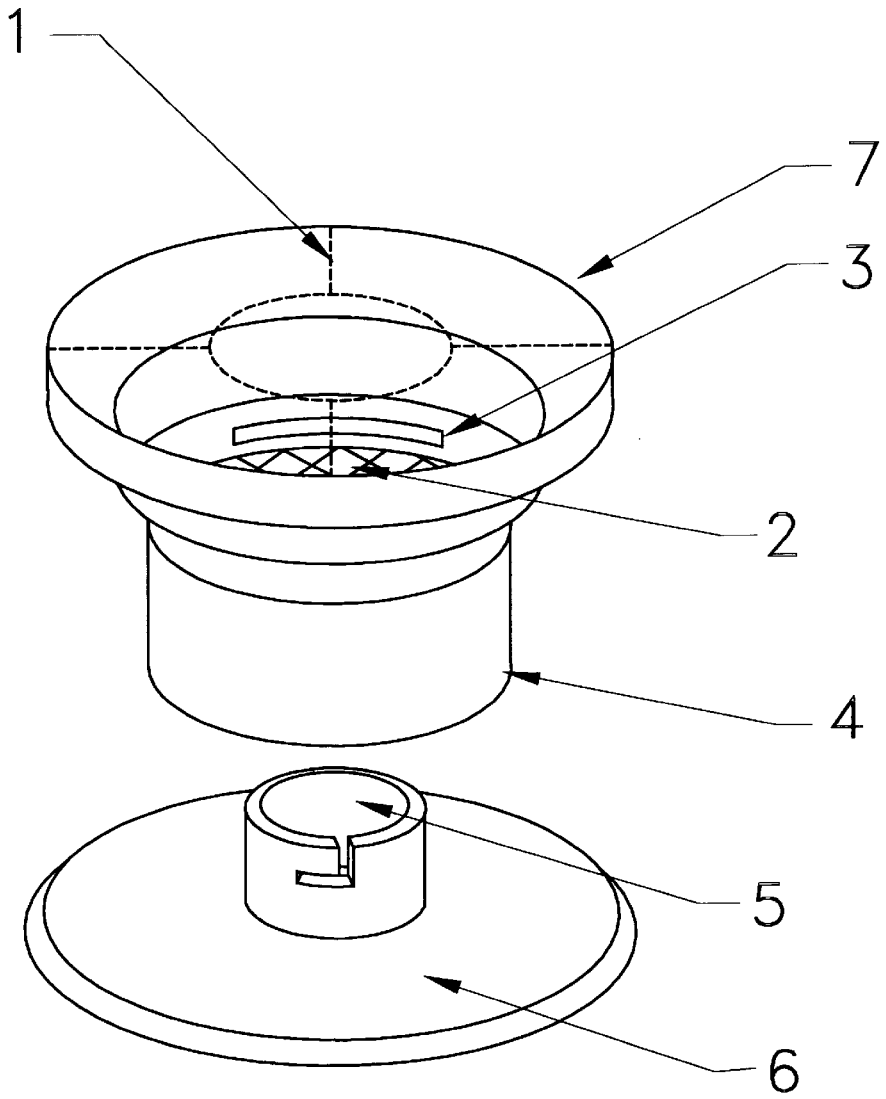
FIG. 2 is a ¾ view of the device illustrating the flexible rubber membrane highlighting the area for insertion of the cigar. Further illustrated is screen for ash filtration; the ventilation slide for increasing or decreasing the burn rate of the cigar; the removable spill-proof ash tray; and the detachable felt lined base for added stability with the one-half turn connection device to tray.
Figure 3:
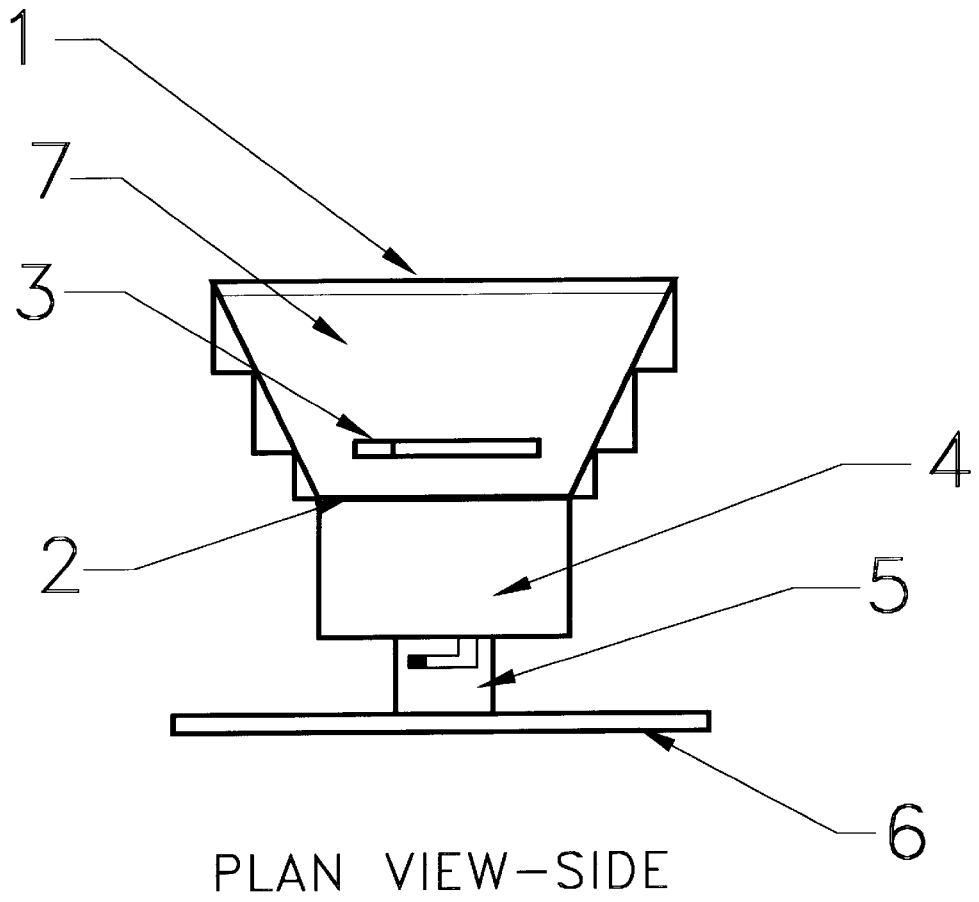
FIG. 3 is a side view of the device illustrating the flexible rubber membrane at the top of the device. Further illustrated is the ventilation slide for the control of cigar burn; the screen for filtering ashes into the accompanying spill-proof ash-tray. Also highlighted is the one-half turn connection of the device to the base in the connected position.

Referring now to the drawings, there is shown in FIG. 1 the flexible rubber membrane top 1 of the which comprises a circular opening for the insertion of the burning cigar into the device just above the sunken filter screen 2. FIG. 2 shows flexible rubber membrane top 1 with the extended rubber panels forming the insertion area of the burning cigar between the rubber panels and the filter screen 2 and the angular ventilation slide for adjusting the burn rate of the cigar. FIG. 2 also shows the spill proof ash tray 4 in the attached position and the detachable felt lined base 6 in the detached position with the one-half turn connection device 5. FIG. 3 shows the rubber membrane extreme top 1 of the device attached to the top section 7 of the device with ventilation slide 3 and filter screen 2. FIG. 3 also shows the attached spill-proof ash tray 4 and the one-half turn base connector 5 in the secure position and the felt lined base 6 of the device in the attached position.

What is claimed is:

1. A combination cigar extinguishing system with a control burn unit having a top section, a one-half turn base connector section, and a felt-lined base, said top section comprising:

a rubber membrane top for inserting a lit cigar in vertical position into the device, a sunken screen positioned a distance below said rubber membrane top a ventilation slide positioned between said rubber membrane top and said sunken screen, for adjusting the burn rate of the cigar and for extinguishing the inserted lit cigar, wherein, said top section is attachable to a spill-proof ashtray for collecting cigar residue, and wherein the top section and ashtray is attachable to the felt-lined base for providing stability for the device.

* * * * *